US005257909A

United States Patent [19]

Glynn et al.

[11] Patent Number: 5,257,909

[45] Date of Patent: Nov. 2, 1993

[54] DOVETAIL SEALING DEVICE FOR AXIAL DOVETAIL ROTOR BLADES

[75] Inventors: Christopher C. Glynn, Hamilton; Roger C. Walker, Middletown; Andrew J. Lammas, Maineville; Richard J. Fallon, West Chester, all of Ohio

[73] Assignee: General Electric Company, Cincinnati, Ohio

[21] Appl. No.: 931,079

[22] Filed: Aug. 17, 1992

[51] Int. Cl.[5] ..... F01D 5/30

[52] U.S. Cl. ..... 416/220 R; 416/219 R

[58] Field of Search ..... 416/220 R, 219 R

[56] References Cited

U.S. PATENT DOCUMENTS

| | | | |
|---|---|---|---|
| 4,470,757 | 9/1984 | Vollinger | 416/221 |
| 4,480,958 | 11/1984 | Schlechtweg | 416/220 R |
| 4,558,988 | 12/1985 | Kisling et al. | 416/220 R |
| 4,701,105 | 10/1987 | Cantor et al. | 416/95 |
| 4,854,821 | 8/1989 | Kernon et al. | 416/95 |
| 4,890,981 | 1/1990 | Corsmeier et al. | 416/220 R |
| 5,052,893 | 10/1991 | Catte | 416/220 R |
| 5,169,289 | 12/1992 | Lalanne | 416/220 R |

*Primary Examiner*—John T. Kwon
*Attorney, Agent, or Firm*—Jerome C. Squillaro

[57] ABSTRACT

A sealing device for compressor axial dovetail rotor blades for a gas turbine engine comprising a sealing member having a finger portion extending from a main body portion which engages a disk hook located on each disk post and forms a first point of contact about which the sealing member rotates. The sealing member further comprises an extended skirt portion which engages the blade platform of the rotor blades forming a second point of contact. The main body has a center of gravity positioned such that during operation of the engine the main body pivots due to centrifugal force about the disk hook such that the skirt portion engages the blade platform. A split ring is located between the disk posts and a tail portion extending from the lower portion of the sealing member and engages the disk post and tail portion during operation of the engine thereby forming a third point of contact. The combination of the skirt element contacting the blade platform and the split ring contacting the tail portion and the disk posts effectively prevents any leakage axially through the rotor blade dovetail.

20 Claims, 3 Drawing Sheets

DOVETAIL SEALING DEVICE FOR AXIAL DOVETAIL ROTOR BLADES

BACKGROUND OF THE INVENTION

This invention relates to aircraft gas turbine engines and, more particularly, to sealing devices for axial dovetail compressor blades of such engines.

Aircraft gas turbine engines include compressor and turbine sections, each including one or more stages having an annular array of stator vanes adjacent to a rotating disk having an array of rotor blades. For certain stages, a rotor blade includes a dovetail-shaped base or root which is received within an axially-extending dovetail slot formed between adjacent dovetail posts on the rim of the rotor disk. The connection between the root of the rotor blade and the axial slot in the disk posts prevents radial and tangential movement of each rotor blade relative to the rotor disk.

In order to prevent axial movement of the rotor blades, blade retainers are mounted adjacent to axial slots in the rotor disk. These blade retainers preferably are secured directly to the rotor disk to minimize the weight and space occupied by such retainers. However, such retainers should be easily removable to facilitate replacement of the rotor blades.

To maximize compressor performance, air leakage through the blade dovetail connections with the disk should be minimized. Air leakage at this connection occurs through spaces between the blade root dovetail and adjacent disk posts of each such connection.

Previous attempts to seal these gaps between the blade roots and disk posts included applying a flexible seal material either to the blade root or to the disk post prior to assembly. This method of sealing proved unsatisfactory in that it made attachment of the rotor blades to the rotor disk difficult. Additionally, the sealing material had to be flexible to effect a seal, but the temperature range over which the sealing material was useful and therefore effective proved to be limited. Consequently, the extreme temperatures produced within the compressor renders seals of flexible sealing material inadequate to prevent compressor leakage.

An alternate method of sealing rotor blades on blade disks includes installing sheet metal between a hook formed on the rotor blade platform and an annular groove located on the disk spacer arm. This method of sealing was also proven to be problematic in that the position of the seal during engine operation is not determinant and therefore good sealing is not guaranteed. Another problem with this type of seal is that during engine operation, the centrifugal load of the seal is carried by the blade which increases the blade load, and consequently causes excessive wear problems on the blades. Additional material had to be added to both the blade dovetail and rotor disk to carry the load created by this type of seal. Therefore, a need exists for an improved apparatus for sealing axial dovetail rotor blades that eliminates the problems associated with previous sealing mechanisms, is inexpensive to manufacture and relatively easy to install.

SUMMARY OF THE INVENTION

The present invention is a dovetail sealing device for axial dovetail rotor blades which substantially reduces the problems occurring with prior sealing devices, thereby maximizing compressor performance. The invention includes an annular main body having fingers extending radially therefrom which mate with radially-extending hooks positioned on the aft faces of the associated disk posts. The engagement fingers and disk hooks form a point of contact. The annular member also includes a skirt portion which extends radially outwardly from the contact point and contacts the blade platform, thereby providing multiple contact points. The annular member further includes a tail portion which extends radially inwardly from the fingers toward the disk spacer arm. A split ring is located in a notch formed between the tail portion and the disk post to provide a seal between the annular member and the aft face of the disk.

The center of gravity of the seal is offset in a direction aft of the point of contact of the seal with the disk hook. During operation of the associated engine, the disk rotates and the resultant centrifugal force causes the annular member to pivot during operation such that the skirt portion urges against the blade platform to establish the second sealing point. The split ring is likewise urged radially outwardly during engine operation by centrifugal force and is wedged into the notch between the aft face of the disk post and the adjacent surface on the tail of the sealing device. The combination of the seal contacting the blade platform and the split ring contacting the seal and the disk post effectively prevents leakage axially through the dovetail connection. Due to the configuration of the split ring with respect to the seal, the load imposed by the split ring on the seal increases the load between the seal and the blade at the contact made by the skirt portion against the blade platform, thereby improving the overall performance of the sealing device.

Accordingly, it is an object of the present invention to provide a sealing device for axial dovetail rotor blades which retains the rotor blades axially; a sealing device which provides an effective seal of a dovetail connection over a wide temperature range; a sealing device that provides known points of contact radially inwardly and axially outwardly of the blade dovetail connection; a sealing device which decreases blade wear by allowing the centrifugal loads to be carried by the disk rather than the blade dovetail generated during engine operation, and a sealing device that is easy to manufacture, install and maintain.

These and other features and advantages of the present invention will be better understood by reference to the following detailed description, the accompanying drawings and the appended claims.

DETAILED DESCRIPTION

Figure 1:
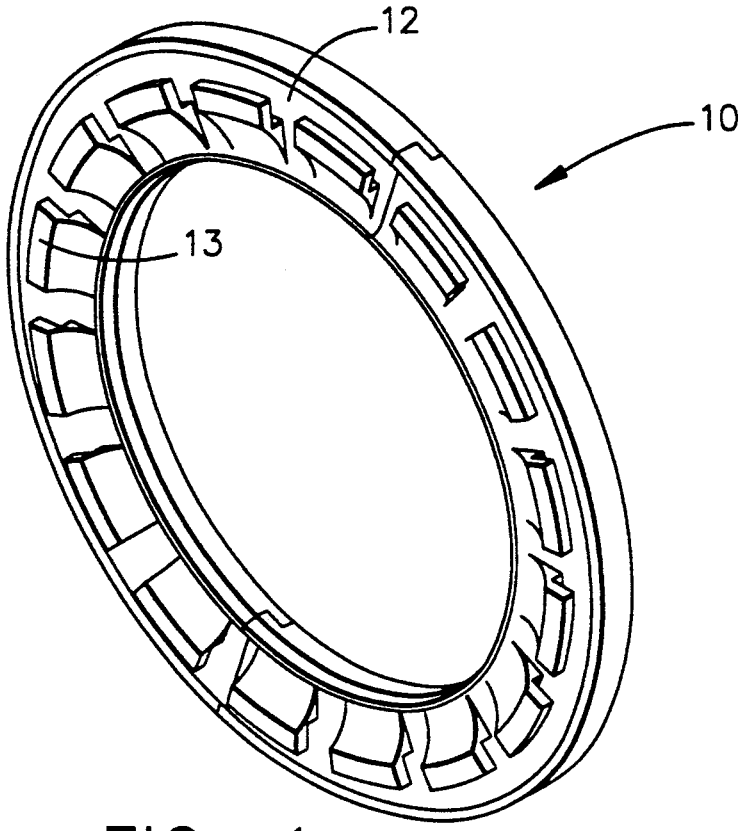
FIG. 1 is a perspective view of the main body portion of the sealing device of the present invention.
Figure 1A:
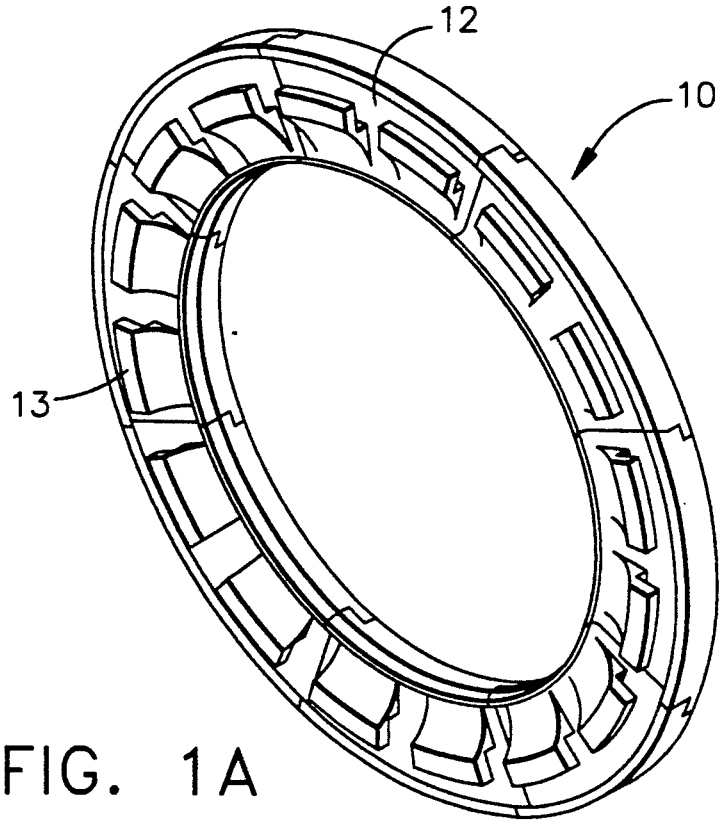
FIG. 1A is a perspective view of the main body portion of an alternate embodiment of the invention
Figure 3:
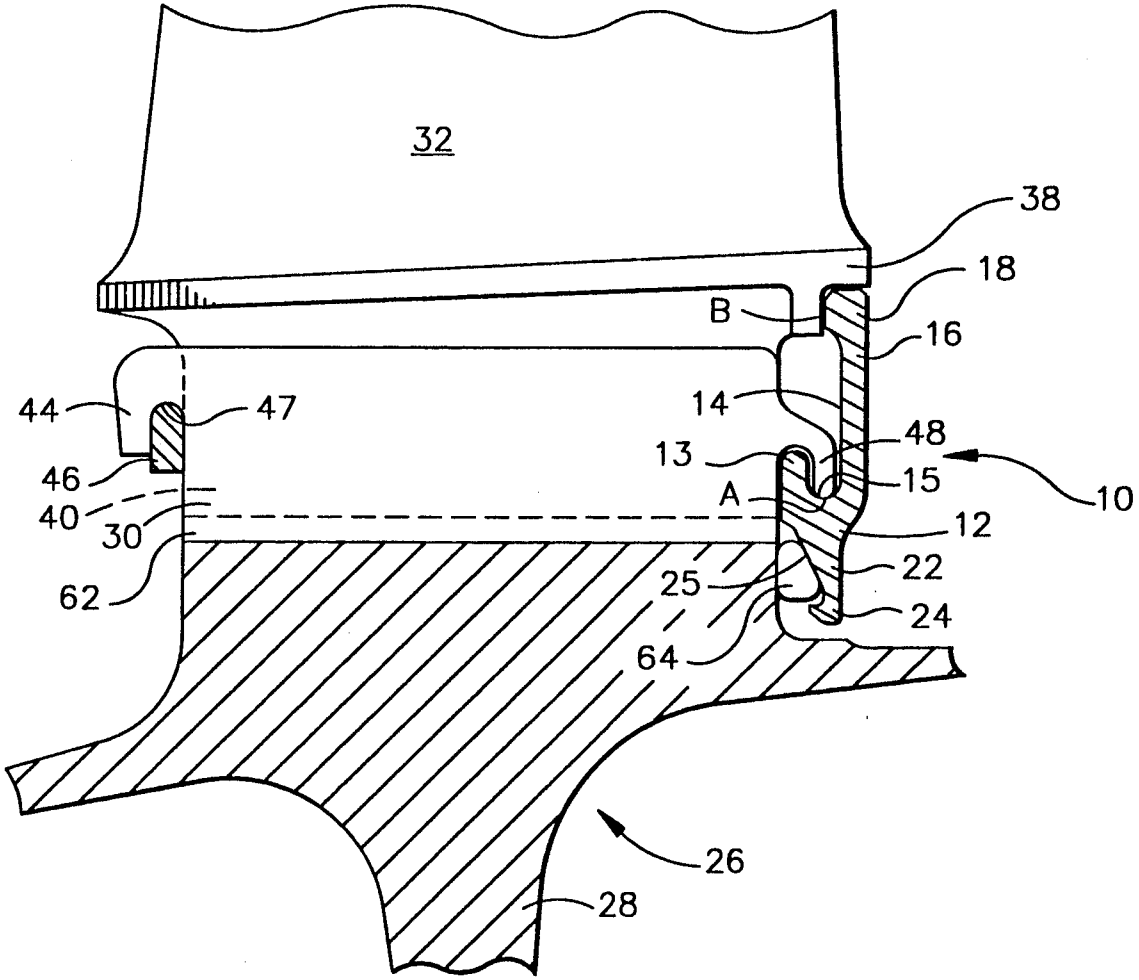
FIG. 3 is a side elevational view of the sealing device of the present invention taken along line 3—3 of FIG. 2.

As shown in FIGS. 1 and 3, the present invention is a dovetail sealing device, generally designated 10, which includes an annular main body 12, which may be in two identical segments as in FIG. 1, eight identical segments as in FIG. 1A, or any desired number of segments to facilitate assembly and maintenance. Main body 12 includes a finger portion 13 projecting forwardly and radially outwardly from the front surface 14 of the main body, thereby forming an annular groove 15 with the front surface.

The main body 12 includes a skirt portion 16 extending radially outwardly from the main body and terminating in a thickened, forwardly-protruding annular head portion 18. A tail portion 22 extends radially inwardly from the main body and terminates in a forwardly-projecting rim 24. The main body 12 tapers in thickness radially inwardly from the finger 13 to the rim 12, forming an angled wall 25.

Figure 2:
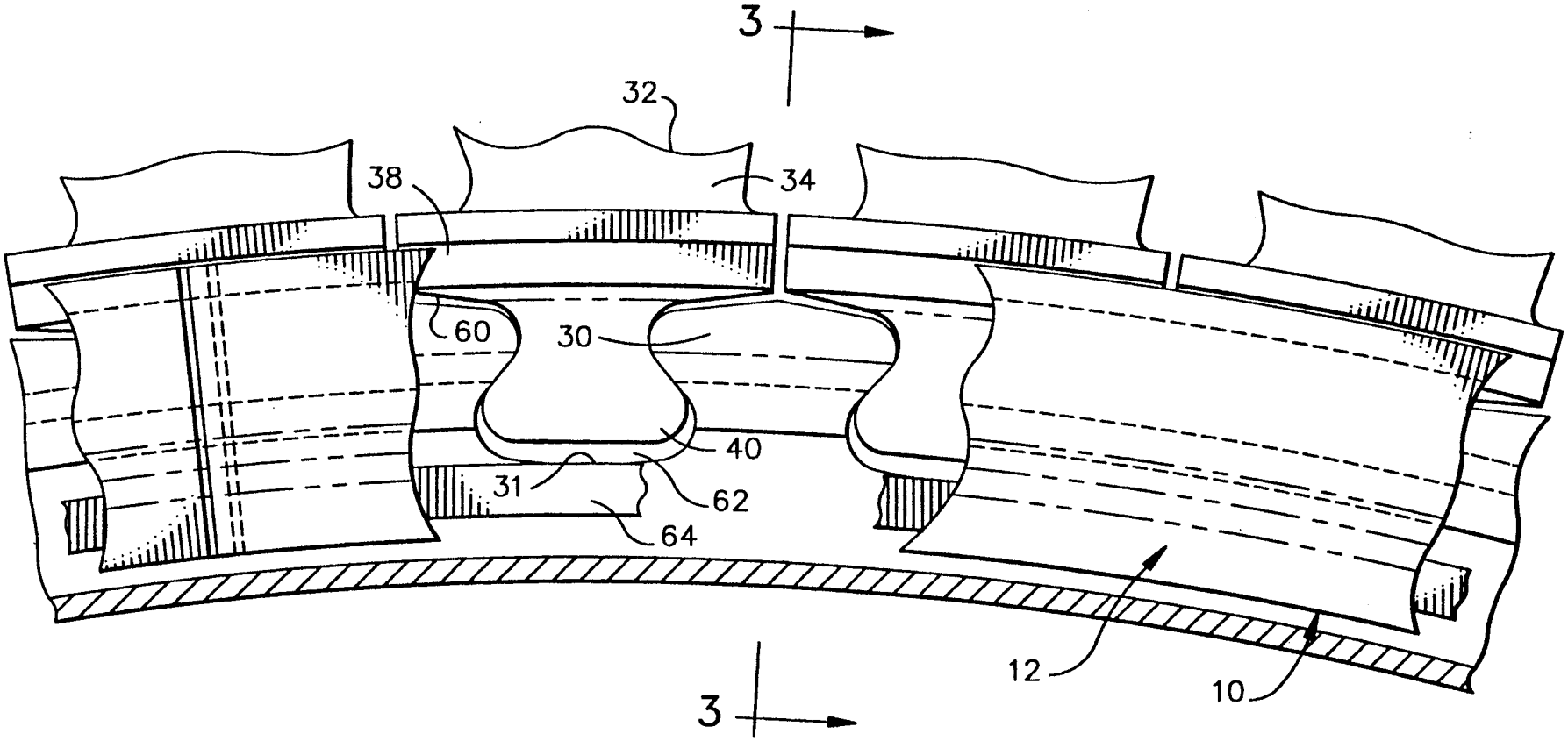
FIG. 2 is a detail aft elevational view at line 2—2 of FIG. 3, showing the sealing device of the present invention mounted on a rotor disk wherein the main body portion is partially broken away.

As shown in FIGS. 2 and 3, the sealing device 10 is mounted on a rotor disk 26 of a gas turbine engine. The disk 26 includes a web 28 and a plurality of disk posts 30 extending radially outwardly from the web 28. The disk posts 30 are shaped and spaced to form dovetail slots 31 about the periphery of the disk 26. The rotor disk 26 supports a circumferentially-extending row or array of rotor blades 32, partially illustrated in FIG. 2. Each rotor blade 32 comprises an airfoil 34 having a blade tip (not shown), a platform 38 at the base of the air foil and a dovetail root 40.

The dovetail root 40 of each rotor blade 32 is shaped to slide axially into the dovetail slot 31 formed by adjacent disk posts 30 of the rotor disk 26. With the rotor blades 32 in position, each blade is held in place against movement relative to the disk 26 both in a radial direction and in a tangential direction by the disk posts 30.

The rotor blades 32 are retained against relative axial movement in the forward direction by a forward disk hook 44 mounted on the forward face of the disk post 30. A blade retaining split ring 46 is located on the forward face of the disk posts 30 and expands to seat within the grooves 47 formed between the hooks 44 and the front faces of the disk posts. The rotor blades 32 are retained against relative axial movement in the aft direction by an aft disk hook 48, mounted on the aft face of the disk post 30 and projecting rearwardly from the aft face of the disk posts 30 and radially inwardly into the annular groove 15 of the main body 12.

The sealing device 10 is designed to seal air traveling through the gaps 60, 62 between the dovetail root 40 and the dovetail slot 31. The sealing device 10 is held in place by disk hook 48 which extends into the channel 15 between the finger portion 13 and the front face 14, such that the finger portion rests between the aft face of the disk posts 30 and the blade root 40. The disk hook 48 contacts the finger portion 13 in the groove 15 at contact area A.

The center of gravity of the sealing device 10 is aft of the point of contact A between the disk hook 48 and the sealing device 10 such that during operation of the engine, the sealing device will rotate or pivot counter clockwise relative to the disk 26 about contact A, due to centrifugal force, forcing the head portion 18 of skirt portion 16 to contact the blade platform 38, forming a second point of contact B. The disk hook 48 not only aligns the sealing device 10 axially, but also supports the centrifugal load of the sealing device during operation.

A split ring 64 is positioned adjacent to the disk post 30 below the main body 12 of the sealing device 10 and abuts the wall 25 adjacent to the tail portion 22. The split ring 64 is retained in this position by the head portion 24 of the tail. As the split ring 64 is urged outwardly by centrifugal force during operation of the engine, it contacts the disk posts 30 and the wall 25 of tail portion 22, further sealing against dovetail leakage. The seals formed at contact B and at split ring 64 reduce leakage through the dovetail slot 31 to a minimum. The centrifugal load imposed by the split ring 64 on the sealing device 10 increases the pivoting force between the sealing device 10 and the rotor blade 32 at the blade platform 38, further improving the sealing at contact point B.

The present invention has been presented with reference to a presently preferred embodiment to the invention shown in the drawings and specifically for compressor stages 3 through 7. Workers skilled in the art and technology to which this invention pertains will appreciate that alterations and changes in the described structure can be practiced without departing from the spirit, principles and scope of this invention. Particularly, the invention provides a method of sealing axial compressor blade dovetails that is determinate i.e., loads and points of contact are known, which is not restricted by temperature limitations, but is equally applicable to other applications where blade dovetail sealing is required such as for turbine blades.

What is claimed is:

1. In a gas turbine engine of a type having a turbine disk including a plurality of spaced disk posts forming blade-retaining slots therebetween and a plurality of blades mounted on said disk and having blade roots shaped to engage said slots, an apparatus for sealing gaps between said blade roots and said posts comprising:

an annular main body shaped to extend about said disk at said disk posts and cover said gaps, said body having a skirt portion engaging said blades radially outwardly of said gaps;

means for interconnecting said disk posts and said main body; and said main body having a center of gravity positioned aft of said interconnecting means such that rotation of said disk and said main body generates centrifugal forces which urge said main body to pivot about said interconnecting means, whereby said skirt portion is urged into sealing engagement with said blades and said disk posts.

2. The apparatus of claim 1 wherein the means for interconnecting said disk posts and said main body include an engaging finger portion extending from said main body and a disk hook extending from each disk post.

3. The apparatus of claim 2 wherein the disk hook extends into a channel defined by the finger portion and the skirt portion engaging the main body and forming a first point of contact.

4. The apparatus of claim 3 wherein the extended skirt portion has a head portion.

5. The apparatus of claim 4 wherein the sealing member rotates about the first point of contact such that the head portion of said skirt portion contacts said blade platform forming a second point of contact.

6. The apparatus of claim 5 wherein the sealing member further includes a split ring located between the disk posts and a tail portion of said sealing member such that during operation of the engine said split ring engages said disk post and said tail portion forming a third point of contact.

7. The apparatus of claim 6 wherein the tail portion has a head portion for retaining the split ring.

8. The apparatus of claim 1 wherein the sealing member is segmented.

9. The apparatus of claim 1 wherein the sealing member is annular.

10. The apparatus of claim 1 wherein the sealing member is for compressor blades.

11. The apparatus of claim 1 wherein the sealing member is for turbine blades.

12. The apparatus of claim 1 wherein the sealing member retains the rotor blades within the disk posts from movement in an aft axial direction.

13. The apparatus of claim 2 wherein the disk hook supports the centrifugal load of the sealing member.

14. An apparatus for sealing rotor blades having a blade platform and axial dovetail blade roots for a gas turbine engine having a plurality of rotor blade disk posts mounted on a web comprising:

a sealing member having a main body;

a finger portion extending from a forward surface of main body;

a skirt portion extending from an aft surface of said main body;

a tail portion protruding from a lower surface of said main body;

a disk hook located on each disk post for engaging said finger portion;

a split ring located between said disk posts and said tail portion.

15. The apparatus of claim 14 wherein the disk hook extends into a channel defined by said finger portion and said skirt portion engaging said main body and forming a first point of contact.

16. The apparatus of claim 15 wherein the sealing member rotates about the first point of contact such that said skirt portion contacts said blade platform forming a second point of contact.

17. An apparatus of claim 16 wherein the split ring during operation of the engine engages said disk post and said tail portion forming a third point of contact.

18. The apparatus of claim 17 wherein the sealing member is segmented.

19. The apparatus of claim 17 wherein the sealing member is for compressor blades.

20. The apparatus of claim 17 wherein the sealing member is for turbine blades.

* * * * *